US010337814B1

(12) United States Patent
Shaker et al.

(10) Patent No.: US 10,337,814 B1
(45) Date of Patent: Jul. 2, 2019

(54) DEARMER POSITIONING SYSTEM

(71) Applicant: Department of the Navy, Indian Head, MD (US)

(72) Inventors: Nicholas Shaker, Springfield, VA (US); Michael Craft, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 541 days.

(21) Appl. No.: 15/330,139

(22) Filed: Aug. 15, 2016

(51) Int. Cl.
*F41A 15/22* (2006.01)

(52) U.S. Cl.
CPC ..... *F41A 15/22* (2013.01)

(58) Field of Classification Search
CPC ..... F42B 33/06; F41A 15/20; F41A 15/22; F16D 2001/062; F16D 1/08; F16D 1/0829; F16D 1/0847; F16D 1/0852; F16D 1/0864; Y10T 403/7047; Y10T 403/7049; Y10T 403/41; F16B 2/06; F16B 2/065
See application file for complete search history.

(56) References Cited

U.S. PATENT DOCUMENTS 2,143,005 A * 1/1939 Green ..... F16B 7/182 248/413
3,368,834 A * 2/1968 Stratienko ..... F16D 1/0829 192/45.1
3,990,804 A 11/1976 Peter et al.
3,998,563 A 12/1976 Kloren
4,006,993 A * 2/1977 Woerlee ..... F16D 1/06 403/359.5
5,085,535 A * 2/1992 Solberg ..... B26D 7/2621 403/13
5,531,536 A * 7/1996 Blanchfield ..... B26D 7/2621 403/24
6,053,656 A * 4/2000 Heilig ..... B62D 1/10 403/362
6,199,291 B1 3/2001 Ozee
7,040,629 B2 5/2006 Horisberger
7,516,535 B1 * 4/2009 Emery ..... F16D 1/0829 277/369
8,448,993 B2 5/2013 Cumic et al.
8,827,216 B2 9/2014 Brown et al.
8,944,718 B2 * 2/2015 Smith ..... B23P 11/00 403/371
9,291,205 B2 * 3/2016 Widenmeyer ..... F16D 1/0847
9,651,172 B2 * 5/2017 McNamee, Jr. ..... F16L 3/1066

* cited by examiner

*Primary Examiner* — Jonathan P Masinick
(74) *Attorney, Agent, or Firm* — Fredric J. Zimmerman

(57) ABSTRACT

A dearmer positioning system has two assemblies, each of which circumscribes a dearmer's barrel. Each of the two assemblies includes two half rings and a one-piece outer ring. The two half rings are joined to one another to define a full ring having a first central opening defining a first diameter. The full ring has a periphery defining a second diameter. The one-piece outer ring has a second central opening defining a third diameter, and a periphery defining a fourth diameter. The third diameter is greater than the second diameter such that the full ring slidingly fits in the central opening of the outer ring. Threaded fasteners engage the outer ring and extend radially through the outer ring and into its central opening to engage the periphery of the full ring.

18 Claims, 2 Drawing Sheets

DEARMER POSITIONING SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to explosive ordnance disposal tools, and more particularly to a system for positioning a dearmer centrally in a gun barrel.

BACKGROUND OF THE INVENTION

Explosive ordinance disposal (EOD) includes the removal of projectiles that have gotten stuck in the barrel of an artillery gun. When projectiles are stuck, EOD personnel generally place a dearmer barrel near the stuck projectile in the gun's barrel. A dearmer barrel houses an explosive that, when detonated, acts to dislodge the stuck projectile. Proper positioning of the dearmer barrel in the gun barrel is critical regardless of the gun barrel's caliber.

SUMMARY OF THE INVENTION

Accordingly, it is an object of the present invention to provide a dearmer positioning system.

Another object of the present invention is to provide a dearmer positioning system that is adaptable to a variety of gun barrel calibers.

Other objects and advantages of the present invention will become more obvious hereinafter in the specification and drawings.

In accordance with the present invention, a dearmer positioning system has two assemblies, each of which is adapted to circumscribe a dearmer. Each of the two assemblies includes two half rings and a one-piece outer ring. The two half rings are joined to one another to define a full ring having a central opening defining a first diameter. The full ring has a periphery defining a second diameter. The one-piece outer ring has a central opening defining a third diameter, and a periphery defining a fourth diameter. The third diameter is greater than the second diameter such that the full ring slidingly fits in the central opening of the outer ring. A plurality of threaded fasteners threadably engage the outer ring and are accessible from the periphery of the outer ring. Each threaded fastener extends radially through the outer ring and into its central opening to engage the periphery of the full ring.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
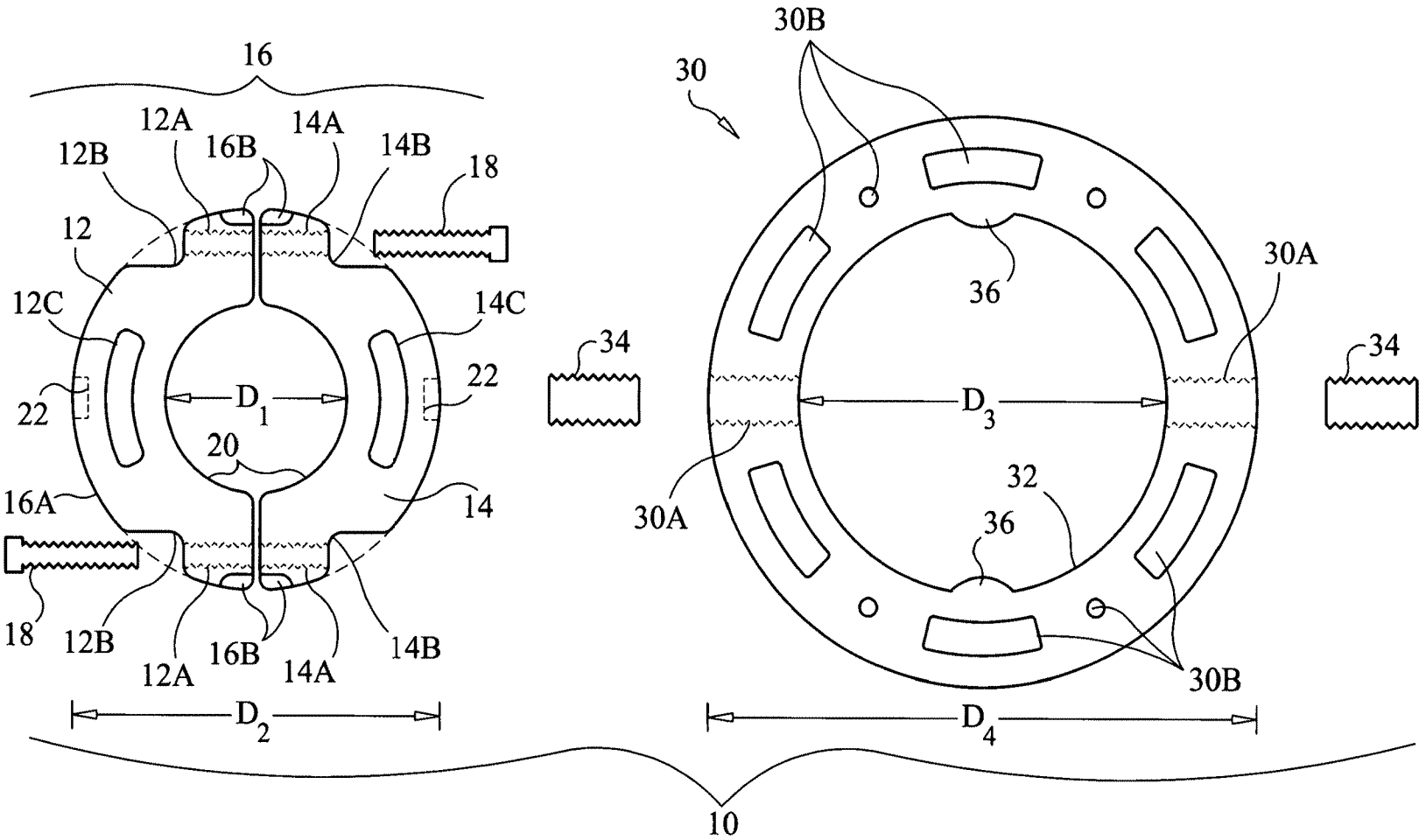
FIG. 1 is an exploded plan view of one of the assemblies included in a dearmer positioning system in accordance with an exemplary embodiment of the present invention.
Figure 2:
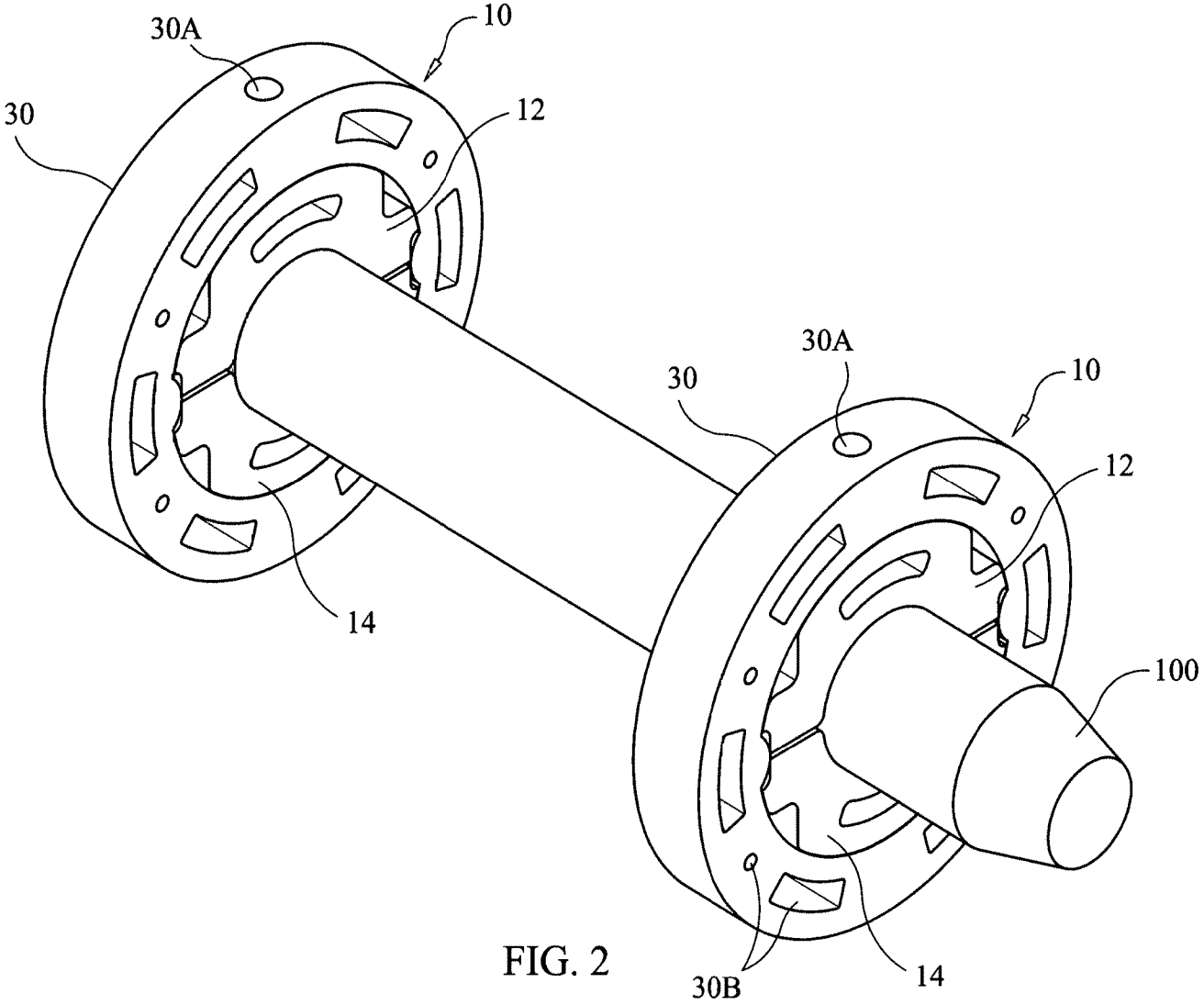
FIG. 2 is a perspective view of the dearmer positioning system clamped onto a dearmer's barrel in accordance with an exemplary embodiment of the present invention.

Referring now to the drawings, simultaneous reference will be made to FIGS. 1 and 2 where FIG. 1 is an exploded plan view of one of two assemblies included in a dearmer positioning system in accordance with an exemplary embodiment of the present invention. FIG. 2 is a perspective view of two of the assemblies illustrated in FIG. 1 assembled to define the present invention's dearmer positioning system that has been clamped onto a dearmer's barrel 100 in preparation for being placed in gun's barrel (not shown) having a projectile stuck therein.

The dearmer positioning system of the present invention includes two of the assemblies shown in FIG. 1. A complete assembly is referenced generally by numeral 10. Assembly 10 includes two C-shaped half rings 12 and 14 made of a rigid plastic material that may be joined to one another to define a full ring 16 whose periphery 16A lies on or within a circle having a diameter "$D_2$". Threaded bolts 18 may be used to join half rings 12 and 14 where threaded bolts 18 may engage aligned threaded sleeves 12A and 14A provided in half rings 12 and 14, respectively. When half rings 12 and 14 are joined to define full ring 16, a central circular opening 20 of diameter "$D_1$" is defined through full ring 16. Diameter $D_1$ is selected such that dearmer barrel 100 may pass through opening 20 and such that full ring 16 clamps onto dearmer barrel 100 when threaded bolts 18 are tightened to draw half rings 12 and 14 together. To assure that the heads of threaded bolts 18 stay within the circle of diameter $D_2$, half rings 12 and 14 may be notched at 12B and 14B, respectively, to keep bolts 18 recessed within the confines of diameter $D_2$. For reasons that will be explained further below, radially-extending holes 22 are defined in the periphery of full ring 16. In the illustrated example, holes 22 are in diametric opposition to one another.

For purposes of versatility, diameter $D_2$ may be selected to allow full ring 16 to slide within a particular caliber of gun barrel (e.g., a 105 millimeter gun barrel). In this way, two of full ring 16 may be used to clamp onto a dearmer barrel. Since lodged projectile removal often requires a gun barrel to be flooded with water, each of half rings 12 and 14 may incorporate axially-extending through holes 12C and 14C, respectively. The inclusion of holes 12C and 14C facilitates the sliding of full ring 16 down a flooded gun barrel.

Assembly 10 also includes a one-piece outer ring 30 made of a rigid plastic material having a central circular opening 32 of diameter "$D_3$" that is sized such that full ring 16 slidingly fits in opening 32. Full ring 16 is coupled to outer ring 30 using threaded fasteners 34. In the illustrated example, two threaded fasteners 34 are threaded into/through diametrically-opposed threaded sleeves 30A that radially extend through outer ring 30. When full ring 16 is to be coupled to outer ring 30, threaded fasteners 34 extend into opening 32 to engage aligned holes 22 of full ring 16. Threaded fasteners 34 are sized such that they do not extend beyond the diametric periphery of outer ring 30 when they engage full ring 16.

The outer diameter "$D_4$" of outer ring 30 is selected to allow outer ring 30 to slide within a particular larger caliber of gun barrel (e.g., a 155 millimeter gun barrel). Two of assembly 10 (as shown in FIG. 2) are coupled to dearmer barrel 100 when a stuck projectile is to be removed from a gun barrel whose caliber permits outer ring 30 to slide therein. Axially-extending through holes 30B may be included in outer ring 30 to facilitate the sliding of each outer ring 30 down a flooded gun barrel.

In the illustrated exemplary embodiment, holes 22 (in full ring 16) and threaded sleeves 30A (in outer ring 30) are each in diametric opposition (opposite) to facilitate alignment of holes 22 with sleeves 30A during the assembly process. To keep full ring 16 from pivoting about threaded fasteners 34 while also assuring alignment of threaded sleeves 30A with holes 22, full ring 16 may be indexed to outer ring 30. For example, tabs 36 may be provided along opening 32 for engagement by depressions or receptacles 16B defined in the periphery of full ring 16. More specifically, in the illustrated exemplary embodiment, tabs 36 are in diametric opposition (opposite) to one another and are each located 90° from threaded sleeves 30A. To balance any pivoting loads acting on full ring 16, each receptacle 16B is formed partially in half ring 12 and partially in half ring 14.

The advantages of the present invention are numerous. The positioning system securely and accurately positions a dearmer barrel in the central region of a gun's barrel. The system is adaptable to a variety of gun barrel calibers. The system may be expanded to even larger caliber guns by adding an additional outer ring sized to mate with such larger caliber guns.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A dearmer positioning system, comprising:

two assemblies, each of said two assemblies adapted to circumscribe a dearmer, each of said two assemblies includes two half rings, a one-piece outer ring, and a plurality of threaded fasteners, said two half rings joined to one another to define a full ring to include a first central opening to define a first diameter, said full ring includes a periphery defining a second diameter, said one-piece outer ring includes a second central opening to define a third diameter, said one-piece outer ring includes a periphery to define a fourth diameter, wherein said third diameter is greater than said second diameter, and wherein said full ring slidingly fits in said second central opening of said outer ring, and wherein said plurality of threaded fasteners threadably to engage said one-piece outer ring and accessible from said periphery of said one-piece outer ring, each of said threaded fasteners extends radially through said one-piece outer ring and into said central opening of said one-piece outer ring to engage said periphery of said full ring.

2. The dearmer positioning system as in claim 1, wherein axially-directed through holes are defined in each of said half rings and said one-piece outer ring.

3. The dearmer positioning system as in claim 1, further comprising tabs being defined along said second central opening of said one-piece outer ring; and receptacles being defined along said periphery of said full ring for engagement with said tabs.

4. The dearmer positioning system as in claim 3, wherein said tabs comprise two tabs positioned in diametric opposition to one another.

5. The dearmer positioning system as in claim 3, wherein each of said receptacles is defined partially in each of said half rings.

6. The dearmer positioning system as in claim 1, wherein said two half rings and said one-piece outer ring comprise a rigid plastic material.

7. A dearmer positioning system, comprising:

two assemblies, each of said two assemblies adapted to circumscribe a dearmer, each of said two assemblies includes two half rings, a one-piece outer ring, and two threaded fasteners, wherein said two half rings joined to one another to define a full ring to include a first central opening to define a first diameter, said full ring includes a periphery to define a second diameter, said periphery of said full ring includes two diametrically-opposed holes defined therein, wherein said one-piece outer ring includes a second central opening defines a third diameter, said one-piece outer ring includes a periphery to define a fourth diameter, wherein said third diameter is greater than said second diameter and wherein said full ring slidingly fits in said central opening of said outer ring, and wherein said two threaded fasteners threadably engage said one-piece outer ring and accessible from said periphery of said one-piece outer ring, each of said threaded fasteners extends radially through said one-piece outer ring and into said central opening of said one-piece outer ring to engage one of said two diametrically-opposed holes in said periphery of said full ring.

8. The dearmer positioning system as in claim 7, wherein axially-directed through holes are defined in each of said half rings and said one-piece outer ring.

9. The dearmer positioning system as in claim 7, further comprising tabs being defined along said central opening of said one-piece outer ring; and receptacles being defined along said periphery of said full ring for engagement with said tabs.

10. The dearmer positioning system as in claim 9, wherein said tabs comprise two tabs positioned in diametric opposition to one another, each of said two tabs located 90° from each of said two threaded fasteners.

11. The dearmer poisoning system as in claim 9, wherein each of said receptacles is defined partially in each of said half rings.

12. The dearmer positioning system as in claim 7, wherein said two half rings and said one-piece outer ring comprise a rigid plastic material.

13. A dearmer positioning system, comprising:

two assemblies, each of said two assemblies adapted to circumscribe and clamp onto a dearmer's barrel, each of said two assemblies including two half rings, a one-piece outer ring, and two threaded fasteners, wherein said two half rings joined to one another to define a full ring where the full ring includes a first central opening to define a first diameter, said full ring includes a periphery to define a second diameter greater than said first diameter, said periphery of said full ring includes two diametrically-opposed and radially-extending holes defined therein, wherein said one-piece outer ring includes a second central opening to define a third diameter, said one-piece outer ring includes a periphery to define a fourth diameter greater than said third diameter, wherein said third diameter is greater than said second diameter and wherein said full ring slidingly fits in said second central opening of said one-piece outer ring, and wherein said two threaded fasteners threadably engage said one-piece outer ring and accessible from said periphery of said one-piece outer ring, each of said threaded fasteners extends radially through said one-piece outer ring and into said central opening of said one-piece outer ring to engage one of said two diametrically-opposed and radially-extending holes in said periphery of said full ring.

14. The dearmer positioning system as in claim 13, wherein axially-directed through holes are defined in each of said half rings and said one-piece outer ring.

15. The dearmer positioning system as in claim 13, further comprising tabs being defined along said central opening of said one-piece outer ring; and receptacles being defined along said periphery of said full ring for engagement with said tabs.

16. The dearmer positioning system as in claim 15, wherein said tabs comprise two tabs positioned in diametric opposition to one another, each of said two tabs located 90° from each of said two threaded fasteners.

17. The dearmer positioning system as in claim 16, wherein each of said receptacles is defined partially in each of said half rings.

18. The dearmer positioning system as in claim 13, wherein said two half rings and said one-piece outer ring comprise a rigid plastic material.

* * * * *